US007347410B2

(12) United States Patent
Atkinson, Jr.

(10) Patent No.: US 7,347,410 B2
(45) **Date of Patent: *Mar. 25, 2008**

(54) LIFTING APPARATUS

(75) Inventor: Ronald Neil Atkinson, Jr., Naperville, IL (US)

(73) Assignee: Titan Products, LLC, Downers Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/298,381

(22) Filed: Dec. 8, 2005

(65) Prior Publication Data

US 2006/0086882 A1 Apr. 27, 2006

Related U.S. Application Data

(63) Continuation of application No. 10/427,381, filed on May 1, 2003, now Pat. No. 6,997,424.

(60) Provisional application No. 60/455,639, filed on Mar. 18, 2003.

(51) Int. Cl.
*B66F 3/00* (2006.01)

(52) U.S. Cl. ..... 254/124; 254/8 B; 108/7

(58) Field of Classification Search ..... 248/346.01, 248/346.05, 157, 161, 345.1; 254/93 H, 254/90, 89 H, 45, 11, 8 B, 8 R, 8 C, 124; 108/7, 6, 147; 5/81.1 R, 83.1
See application file for complete search history.

(56) References Cited

U.S. PATENT DOCUMENTS 1,650,810 A 11/1927 Weaver
1,684,606 A 9/1928 Thielen
2,080,963 A 5/1937 Fiedler
2,404,577 A 7/1946 Jackson
2,588,509 A 3/1952 Forster
2,793,767 A 5/1957 Smith et al.
2,829,863 A * 4/1958 Gibson ..... 254/8 C
3,006,594 A 10/1961 Gruendler
3,109,626 A 11/1963 Ames et al.
3,190,614 A 6/1965 Evers et al.
3,628,771 A * 12/1971 Egeland et al. ..... 254/122
3,648,856 A 3/1972 Gaarder et al.
3,746,307 A 7/1973 Yamazaki
3,765,720 A 10/1973 Sakai
3,876,096 A 4/1975 Latek
3,937,443 A 2/1976 Durgan
3,982,767 A 9/1976 Larsson et al.
4,083,599 A 4/1978 Gaffney
4,127,255 A 11/1978 Wooding
4,185,342 A 1/1980 Young (Continued)

*Primary Examiner*—A. Joseph Wujciak, III
(74) *Attorney, Agent, or Firm*—Foley & Lardner LLP

(57) ABSTRACT

A device for lifting an item such as an article of furniture to gain access underneath for performing a variety of tasks. The device comprises a horizontal actuating beam attached via a hinge member to one or more horizontal support beams that are affixed to the object frame. The horizontal actuating beam is also connected to the one or more horizontal support beams by one or more biasing members. The horizontal actuating beam includes a pivoting axle at one end that is attached to the one or more horizontal support beams and a wheel at the other end that presses downward on a surface and acts as a support point when the front of the object is raised up off of the surface.

10 Claims, 4 Drawing Sheets

U.S. PATENT DOCUMENTS 4,690,378 A 9/1987 Jarman et al.
4,694,930 A * 9/1987 Kishi ..... 182/2.11
4,786,107 A 11/1988 Crockett
4,850,748 A 7/1989 Brink
4,875,555 A 10/1989 Johansson et al.
4,886,242 A 12/1989 Eck et al.
5,033,717 A 7/1991 Symon
5,110,090 A 5/1992 McDuffie
5,131,501 A 7/1992 Yoshikawa
5,141,204 A 8/1992 Marosy
5,174,548 A 12/1992 Mueller
5,181,694 A 1/1993 Collins
5,190,265 A 3/1993 Barry et al.
5,249,643 A * 10/1993 Backer et al. ..... 182/2.11
5,251,875 A 10/1993 Craychee et al.
5,299,779 A 4/1994 Collins
D349,801 S 8/1994 Few et al.
5,429,415 A 7/1995 Meade
5,441,238 A 8/1995 Lindsley, III
5,641,201 A 6/1997 Casey et al.
5,678,977 A 10/1997 Nordlund
5,730,494 A 3/1998 LaPointe
5,915,671 A * 6/1999 Bott ..... 254/124
6,058,798 A 5/2000 Lantzsch
6,231,120 B1 5/2001 Wiecek
6,253,881 B1 7/2001 Andersson
6,332,232 B1 12/2001 Neal
6,354,570 B1 3/2002 Christensen et al.
6,370,716 B1 4/2002 Wilkinson
6,390,451 B1 5/2002 Baker
6,409,151 B1 6/2002 Cormier
6,412,427 B1 7/2002 Merkt
6,471,187 B1 10/2002 Dubé et al.
6,478,352 B1 11/2002 Fredrickson
6,491,269 B1 12/2002 Larson et al.
6,494,538 B1 12/2002 Alvestad
6,761,524 B2 * 7/2004 Chabanas et al. ..... 414/491
6,974,123 B2 * 12/2005 Latvys ..... 254/122
6,997,424 B2 * 2/2006 Atkinson, Jr. ..... 248/346.01

* cited by examiner

LIFTING APPARATUS

CROSS-REFERENCE TO RELATED PATENT APPLICATIONS

This application is a continuation of U.S. application Ser. No. 10/427,381 filed May 1, 2003 now U.S. Pat. No. 6,997,424 which claimed priority to U.S. Provisional Application 60/455,639, filed Mar. 18, 2003, both of which are incorporated herein by reference in their entirety.

FIELD OF THE INVENTION

The present invention relates generally to a lifting apparatus. More particularly, the present invention relates to an apparatus for assisting a user in lifting heavy articles such as furniture.

BACKGROUND OF THE INVENTION

There are a number of situations, both in the home and at work, where a person must gain access to the underside of a heavy article. In the home, for example, a person must often lift a couch, sofa, or other piece of large and/or heavy furniture in order to retrieve items that have fallen beneath the article or to vacuum or clean the region underneath the article. In the case of a large couch or sofa, this can pose a number of safety and health issues. Some articles may weigh well over 100 pounds and may be so large and cumbersome that they are difficult to manipulate. As a result, it can be very difficult for a single person to lift or move the article. This is especially true when the person is elderly, possesses a physical ailment, or otherwise has difficulty in lifting heavy objects. Furthermore, even for people who can lift articles such as couches and sofas with little difficulty, the person will still have a difficult time cleaning or reaching underneath the article while simultaneously keeping the article lifted or tilted. Additionally, this action can create severe safety issues, such as the object falling on the individual as the person attempts to simultaneously work underneath the article and keep the article suspended or tilted.

In the workplace or an industrial setting, similar issues can also arise. For example, custodial personnel often have to lift or tilt office furniture in order to clean in hard-to-reach areas. Certain types of machinery may also need to be lifted and/or tilted in various circumstances in order to work underneath the article. In each of these circumstances, substantial safety issues can arise if a single individual is required to both lift and/or tilt the object and simultaneously perform actions underneath the object.

For all these reasons, it would be advantageous to develop a mechanism that permits a user to quickly and easily lift and/or tilt a large bulky and heavy object such that the person can easily and safely perform actions, such as cleaning, underneath the object.

SUMMARY OF THE INVENTION

The present invention comprises a device for lifting heavy articles, such as sofas and other types of furniture. The device of the present invention provides a system for conveniently lifting an edge of the base of a heavy article, thereby affording access to the area of the floor beneath the article and allowing tasks, such as cleaning, of the area underneath the article. The present invention is preferably adapted to lift one edge of the article in order to provide access to the underside thereof. The present invention may be permanently installed on the underside of the article, while also being hidden from view when not in use. The device of the present invention may also include one or more wheels to permit the attached article to be rolled and moved to a different position with little difficulty. The device of the present invention is easy to use, comprises a relatively few amount of moving parts, and is relatively inexpensive to manufacture.

DETAILED DESCRIPTION OF THE INVENTION

Figure 1:
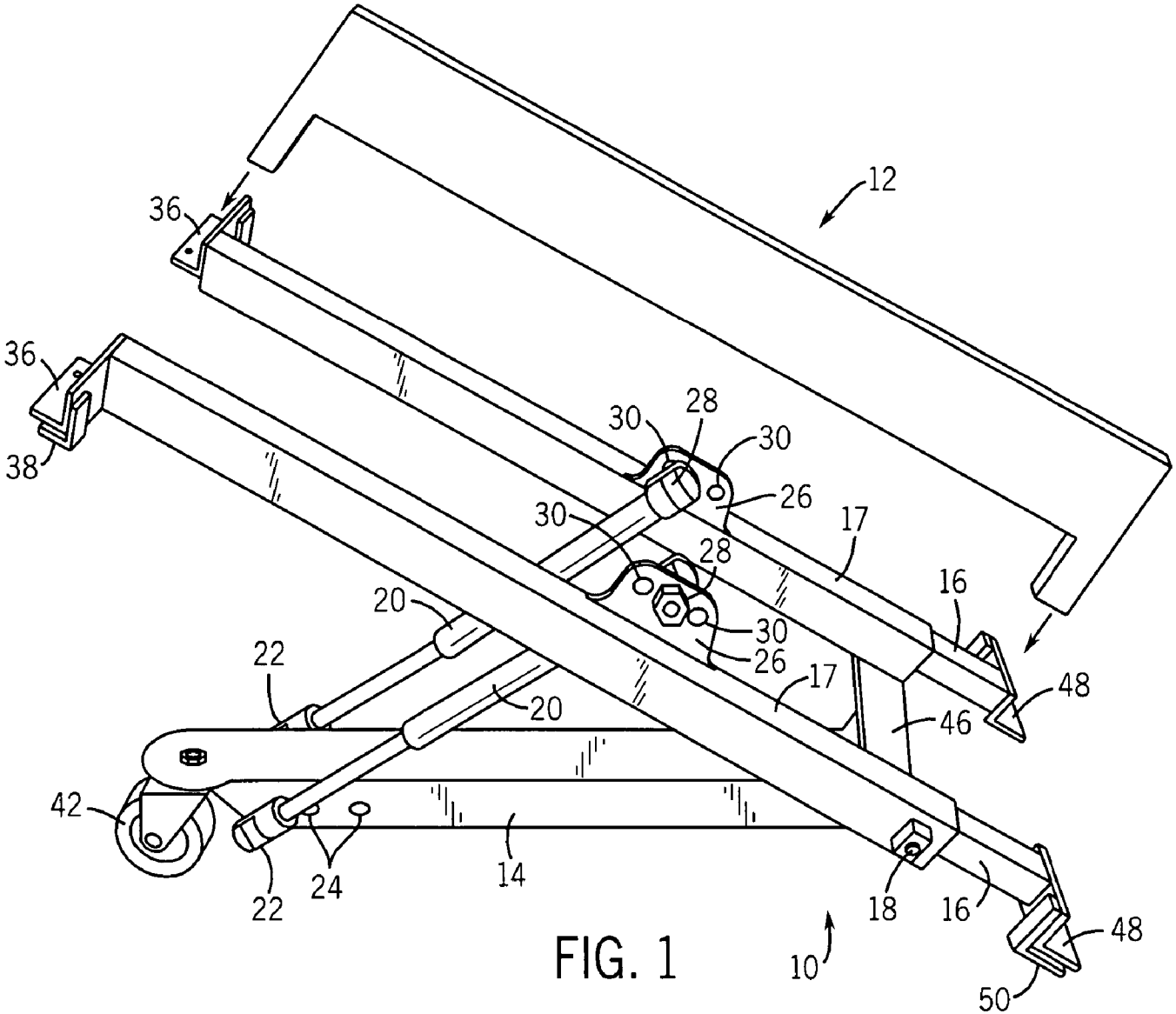
FIG. 1 is a perspective view of an article-lifting device constructed according to the present invention.
Figure 2:
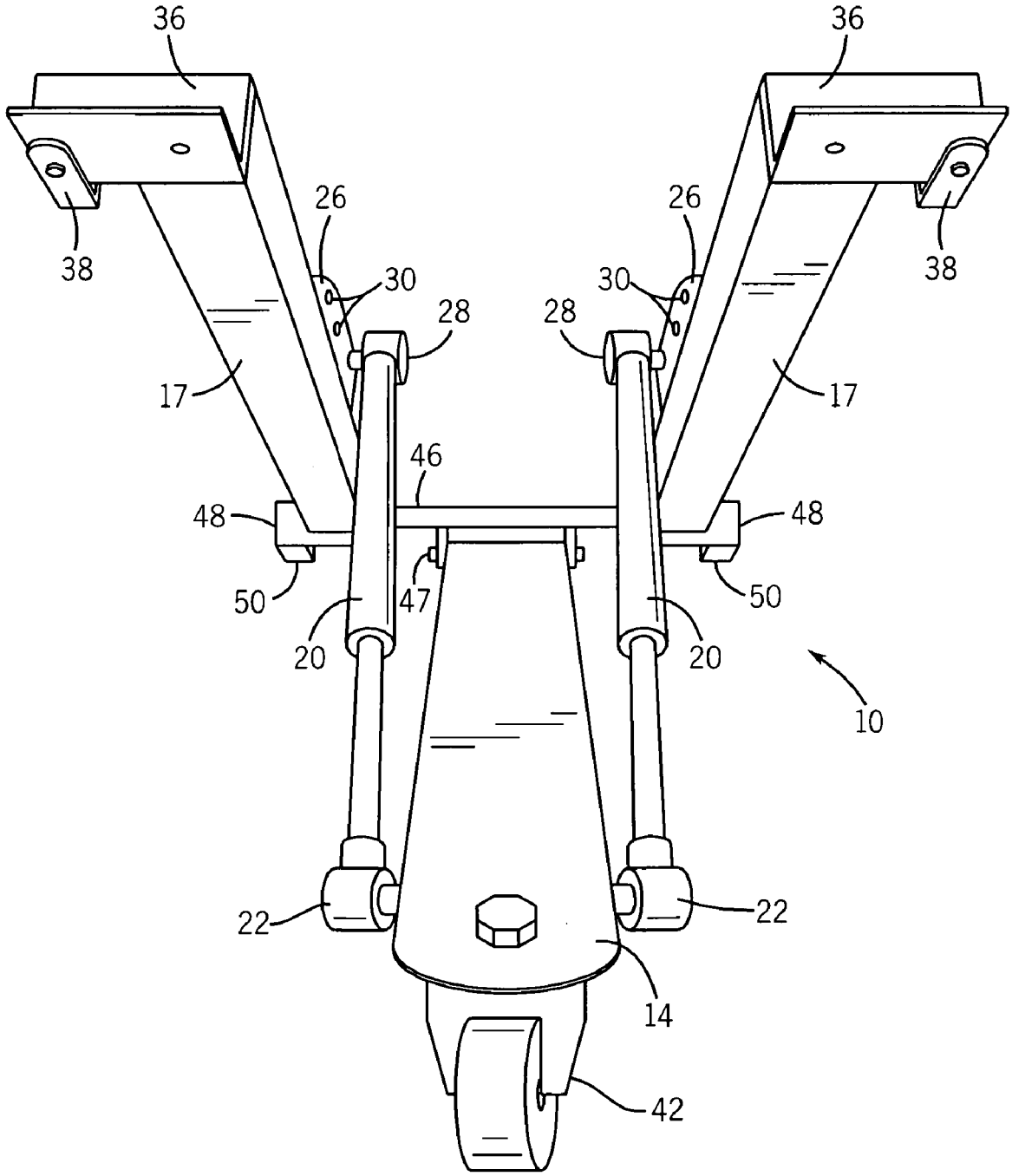
FIG. 2 is a front end view of the article-lifting device of FIG. 1.
Figure 3:
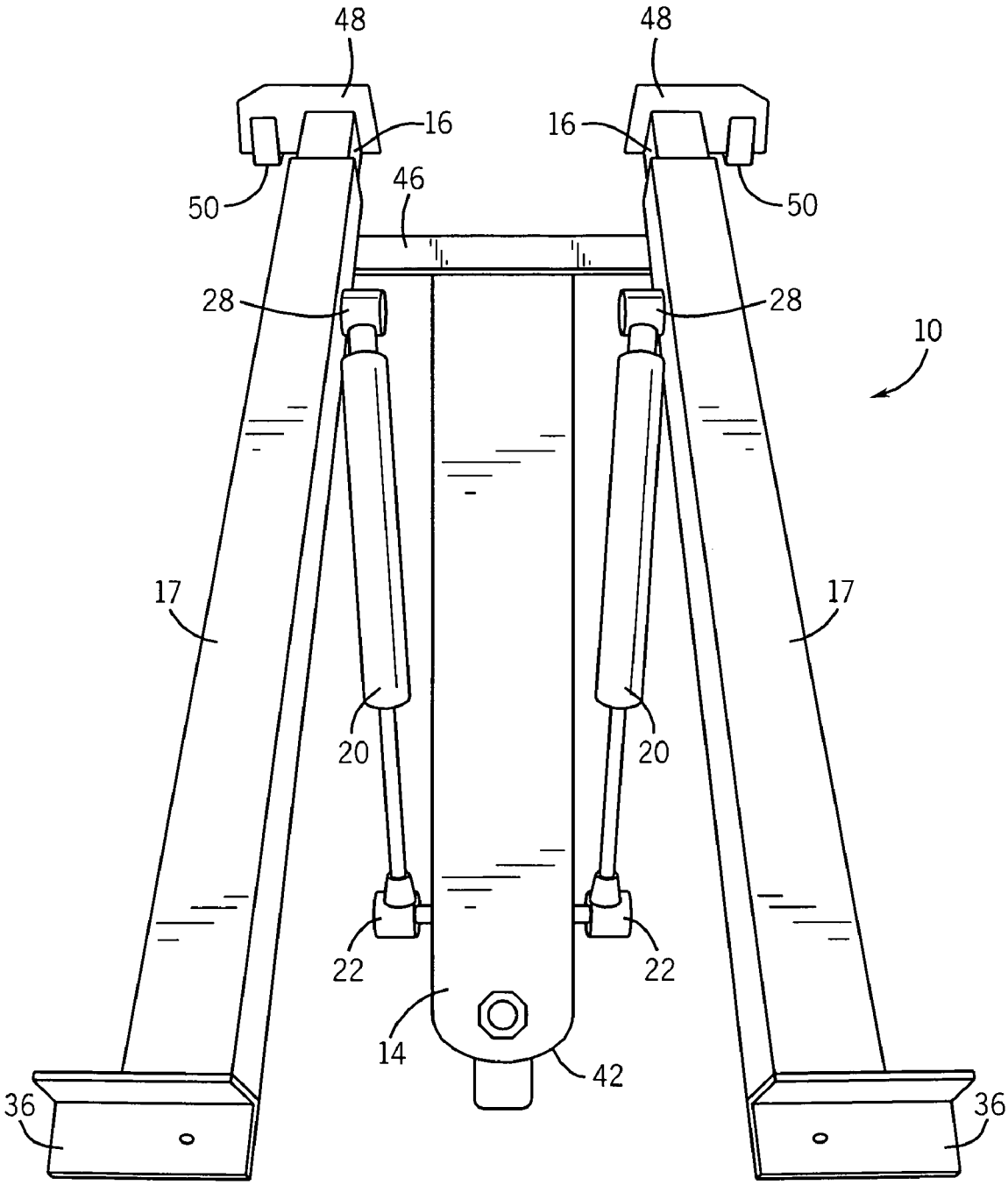
FIG. 3 is a top view of the article-lifting device of FIG. 1.
Figure 4:
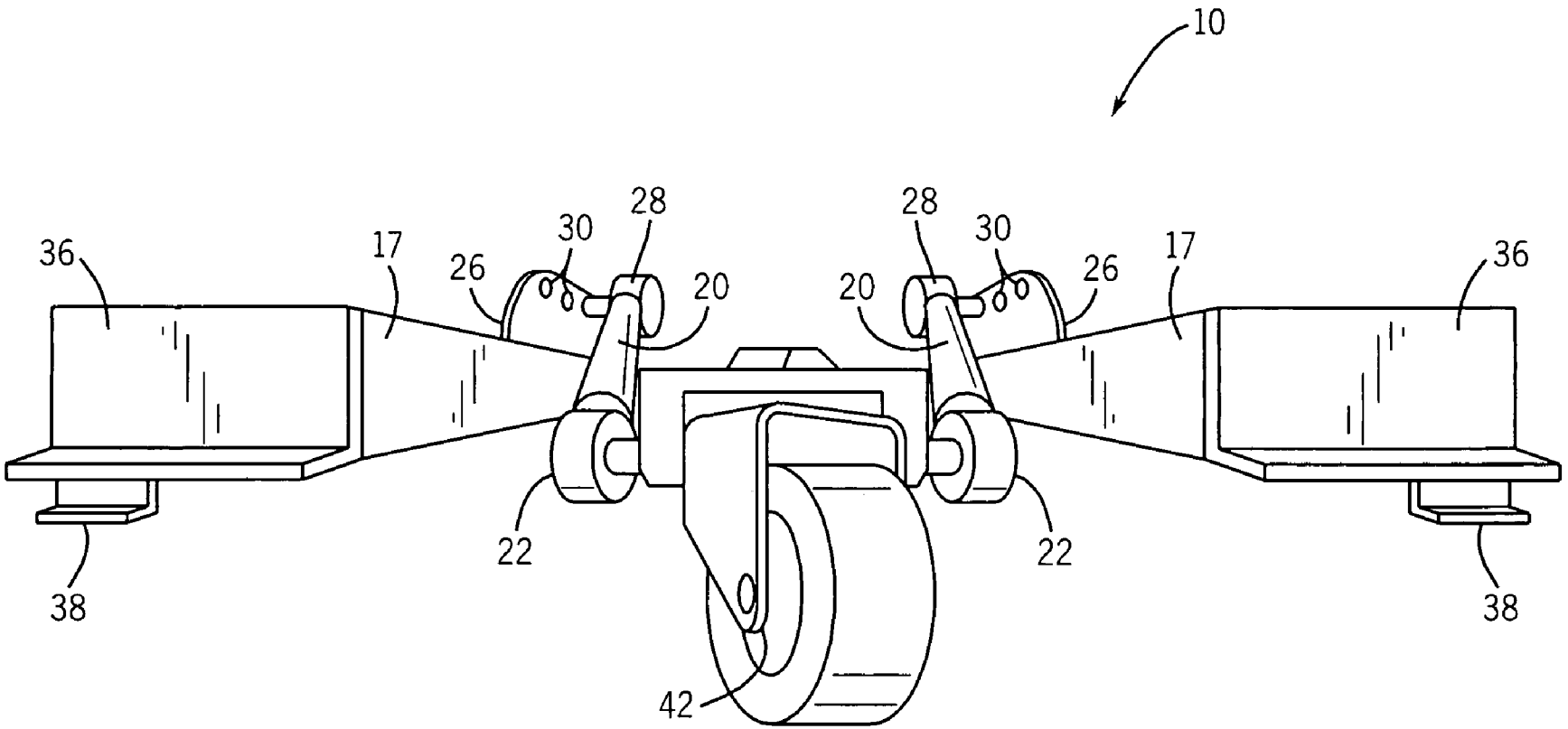
FIG. 4 is a front end view of the article-lifting device of FIG. 1 when in the collapsed position.

A device constructed according to the present invention is shown generally at 10 in FIGS. 1-4, according to a preferred embodiment of the invention, for lifting a heavy article, shown at 12 in FIG. 1, such as a piece of furniture. The device 10 comprises a primary member 14 operatively connected to one or more outer telescoping members 17, which are connected to one or more inner telescoping members 16. Each inner telescoping member 16 is coupled to a corresponding outer telescoping member 17 by a set screw 18 or similar fastener. The use of the set screw 18 permits the effective length of the inner telescoping member 16 and the outer telescoping member 17 to be adjusted in order for the device 10 to attach to articles 12 of different shapes and sizes.

In one embodiment of the invention, the primary member 14 is operatively connected to each outer telescoping member 17 by one or more biasing members 20. In a preferred embodiment of the invention, each biasing member 20 comprises a gas spring. In one embodiment, the gas springs are capable of applying up to about 400 lbs. of force on a surface. In another embodiment, two gas springs can be used to each apply about 375 lbs. of force, totaling about 750 lbs. of force on a surface. However, gas springs having various capacities can be used. Furthermore, other types of biasing members, including coil springs, hydraulic systems or various types of pneumatic systems, could also be used depending upon the particular system and manufacturing requirements. Each biasing member 20 is coupled to the primary member 14 at a lower joint 22. In a preferred embodiment of the invention, the lower joint 22 comprises a 10 millimeter ball joint, although joints of other types and sizes may also be used. Also in a preferred embodiment of the invention, the location at which the biasing members 20 are coupled to the primary member 14 can be adjusted to fit one of a plurality of height adjustment slots 24. The different height adjustment slots 24 permit the user to adjust the ultimate height to which one end of the object 12 is raised during use of the device 10.

In one embodiment of the invention, the end of each biasing member 20 opposite the lower joint is operatively connected to the outer telescoping member 17 via one or more weight adjustment brackets 26. Each biasing member 20 is coupled to the respective weight adjustment bracket 26 at an upper joint 28. In a preferred embodiment of the invention, the upper joint 28 comprises a 10 millimeter ball joint, although joints of other types and sizes could also be used. Like the lower joints 22, the upper joints 28 can be moved to multiple positions 30, in this case to redistribute the weight of the object 12 upon the device 10.

In one embodiment of the invention, each of the inner telescoping members 16 is coupled to the primary member 14 via a secondary member 46 and a hinge member 47. The secondary member 46 serves to fix the distance between each of the respective outer telescoping members 17. The hinge member 47 permits both the inner telescoping members 16 and the outer telescoping members 17 to rotate relative to the primary member 14.

In a preferred embodiment of the invention, the front end of the device 10 includes a primary front frame mounting bracket 36 on each of the outer telescoping members 17. Preferably, the primary front frame mounting bracket 36 is directly coupled to each outer telescoping member 17 and is used as a bracket for use with wood-framed objects. A secondary front frame mounting bracket 38 can also be attached to each primary front frame mounting bracket 36 and can be primarily used for mounting the device to metal or steel-framed objects. Both the primary front frame mounting brackets 36 and the secondary front frame mounting brackets 38 are used to abut against the frame of the object 12. In the case of steel-framed objects, the frame fits between the primary front frame mounting brackets 36 and the secondary front frame mounting brackets 38 and is attached to the secondary front frame mounting brackets 38 via screws or other fastening devices. In the case of wood-framed objects, the frame rests within the cavity formed by the primary front frame mounting brackets 36.

At the rear end of the device 10, a primary rear frame mounting bracket 48 is preferably coupled to each of the inner telescoping members 16. A secondary rear frame mounting bracket 50 is coupled to each primary rear frame mounting bracket 48. Preferably, the primary rear frame mounting bracket 48 is used to secure the device 10 to a wood frame, and the secondary rear frame mounting bracket 50 is used to secure the device 10 to a steel-framed object or a metal-framed object. In the case of steel-framed objects, the frame fits between the primary rear frame mounting brackets 48 and the secondary rear frame mounting brackets 50 and is attached to the secondary rear frame mounting brackets 50 via screws or other fastening devices. In one preferred embodiment of the invention, the secondary rear frame mounting brackets 50, in addition to the secondary front frame mounting brackets 38, can be fastened to the steel frame using screws that are adjustable by standard alien keys, although other types of fasteners are possible. In the case of wood-framed objects, the frame rests within the cavity formed by the primary rear frame mounting brackets 48. The combination of the primary and secondary front frame mounting brackets 36 and 38 and the primary and secondary rear frame mounting brackets 48 and 50 serves to pin the device against the inside of the frame of the object 12.

In one embodiment of the invention, the primary member 14 can also include a wheel assembly 42 affixed to one end thereof. In a preferred embodiment of the invention, the wheel assembly 42 comprises a caster wheel, which aids the device 10 in moving back and forth as the object 12 is raised and lowered.

The operation of the device 10 is generally as follows. When the inner and outer telescoping beams 16 and 17 are affixed to the frame of the object 12 via the respective brackets, and the object 12 is resting firmly on the ground, the inner and outer telescoping members 16 and 17 are substantially co-planer with the primary member 14. When the user desires to lift a portion of the object 12 off of the ground, the user simply lifts the front portion of the object 12 adjacent the front end of the device 10. This lifting actuates the biasing members 20, which provide an added force in the same direction as the lifting. This causes the inner and outer telescoping members 16 and 17 to rotate relative to the primary member 14 via the hinge member 47. As a result of this action, the user is able to quickly and easily tilt the device 10 and the object 12 with relatively little effort as the biasing members 20 rotate relative to the primary member 14. The biasing members 20 also serve to keep the device 10 and the object 12 in the tilted or suspended position without assistance from the user. When in the fully tilted position, the user is capable of working underneath the object 12, performing tasks such as vacuuming, sweeping, retrieving articles, etc.

When the user has completed the activities below the object 12, the user simply applies a downward force on the front end of the object 12. Although the user is required to overcome the forces of the biasing members 20, the user is aided by gravity when applying the downward force, resulting in relatively little effort to place the object 12 firmly on the ground once again as the inner and outer telescoping member 16 and 17 rotate via the hinge member 47.

The device of the present invention includes a number of substantial benefits for individual users in the home or at work. The device of the present invention includes a relatively low number of parts and is inexpensive to manufacture. Furthermore, the device of the present invention can be adjusted to fit articles of many different sizes and shapes and can be permanently affixed to the underside of the article to be manipulated. Additionally, the device of the present invention is usually completely hidden from view when the article is firmly on the ground, eliminating storage issues and also resulting in general aesthetic benefits. The device is simple to use and can be used by people of different ages, sizes and strengths.

It should be understood that the above description of the invention and the specific examples and embodiments, while indicating the preferred embodiments of the present invention, are given by demonstration and not limitation. For example, it is possible that only one inner and outer telescoping member 16 and 17 can be used with the device 10. More than two inner and outer telescoping members 16 and 17 could also be used. Furthermore, it is possible that no inner and outer telescoping members are to be used at all, instead using one or more article support members that do not have adjustable lengths. Likewise, it is possible for a device of the present invention to not include weight adjustment slots, height adjustment slots, or any mechanism for adjusting the maximum height and/or weight capacity of the device. Additionally, the front and rear brackets could be modified in many ways known to those skilled in the art. Biasing members of different types, sizes and capacities can also be used. Furthermore, different types of fasteners can be used in a variety of locations. Many changes and modifications within the scope of the present invention may therefore be made without departing from the spirit of the invention, and the invention includes all such inventions and modifications.

What is claimed is:

1. A lifting mechanism comprising:

a base having a first end and a second end;

a lifting surface pivotally connected at a first pivot point to the base, the lifting surface comprises a first arm and a second arm and the lifting surface configured to directly attach to an article to be lifted;

an extension arm extendable beyond the edge of the lifting surface;

a horizontal member coupled to the first arm and the second arm, the horizontal member hingedly attached to the base member; and an actuator pivotally connected to the base and the actuator connected to the lifting surface, the actuator comprising a first biasing member biasing the first arm and a second biasing member biasing the second arm, wherein a second end of the lifting surface rotates about the first pivot point as the actuator actuates the lifting surface.

2. The lifting mechanism of claim 1, further comprising a plurality of engaging members positioned on the lifting surface for engaging an article.

3. The lifting mechanism of claim 1, wherein the lifting surface comprises a weight adjustment bracket pivotally connected to the actuator.

4. The lifting mechanism of claim 1, wherein the lifting mechanism is permanently affixed to an article of furniture.

5. The lifting mechanism of claim 1, further comprising a wheel assembly attached to and facilitating movement of the base.

6. The lifting mechanism of claim 5, wherein the wheel assembly comprises a caster wheel.

7. The lifting mechanism of claim 1, wherein each of the biasing members comprises a gas spring.

8. The lifting mechanism of claim 1, wherein the base includes a plurality of slots such that the first biasing member and the second biasing member can be attached to the base at multiple positions.

9. The lifting mechanism of claim 1, wherein each of the first arm further comprises a first inner telescoping member and a first outer telescoping member slidably connected to the first inner telescoping member and second arm further comprises a second inner telescoping member and a second outer telescoping member slidably connected to the second inner telescoping member.

10. The lifting mechanism of claim 9, further comprising a plurality of fasteners for fixing the position of the first and second inner telescoping member relative to the respective first and second outer telescoping member.

* * * * *